US006854472B2

(12) United States Patent
Yunakov

(10) Patent No.: US 6,854,472 B2
(45) Date of Patent: Feb. 15, 2005

(54) MAKEUP CASE

(76) Inventor: Sophia Yunakov, 77 Pickwick Rd., Manhasset, NY (US) 11030

( * ) Notice: Subject to any disclaimer, the term of this patent is extended or adjusted under 35 U.S.C. 154(b) by 45 days.

(21) Appl. No.: 10/157,327

(22) Filed: May 29, 2002

(65) Prior Publication Data

US 2002/0179110 A1 Dec. 5, 2002

Related U.S. Application Data

(60) Provisional application No. 60/295,376, filed on Jun. 1, 2001.

(51) Int. Cl.[7] ..... A45D 35/28
(52) U.S. Cl. ..... 132/297
(58) Field of Search ..... 132/297, 294, 132/314, 315; 206/581, 235, 385

(56) References Cited

U.S. PATENT DOCUMENTS 1,336,216 A * 4/1920 Garbeil ..... 132/297
4,526,273 A * 7/1985 Tsuji et al. ..... 206/229
4,555,020 A * 11/1985 Campello et al. ..... 206/235
4,821,751 A * 4/1989 Chen ..... 132/295
5,301,808 A * 4/1994 Pierson ..... 206/581
5,318,053 A 6/1994 Barhnart
5,373,862 A 12/1994 Blachut
5,655,553 A 8/1997 Giese et al.
5,715,848 A * 2/1998 Conley, Jr. ..... 132/297
5,813,420 A 9/1998 Sussman
6,168,024 B1 1/2001 Coates et al.

* cited by examiner

*Primary Examiner*—Todd E. Manahan
(74) *Attorney, Agent, or Firm*—Baker Botts L.L.P.

(57) ABSTRACT

A makeup case has a base member and a cover member joined by a hinge and held closed by a clasp or latch. Each member has a plurality of shallow cavities designed to receive trays of makeup, a mirror, or makeup-related elements. The base member covers the cavities of the cover member when the case is closed and vice versa. At least one of the members also has a plurality of elongated, substantially parallel cavities with one end at a wall of the member that is spaced apart from the edge wall of the member, so as to define a recess or step adjacent to the edge wall, and an opening. A variety of makeup elements are received in the cavities, with an end portion of each implement projection from the cavity into the recess so that it can be grasped to remove the implement. Each element and cavity has interacting structures that releasably retain the element in the cavity in the absence of manipulation by the user to withdraw the element from the cavity.

12 Claims, 3 Drawing Sheets

MAKEUP CASE

PRIORITY CLAIM

The present invention claims priority to U.S. Provisional Patent Application Ser. No. 60/295,376, filed Jun. 1, 2001, which is incorporated by reference herein.

BACKGROUND OF THE INVENTION

The present invention relates to a makeup case and, in particular, to a small makeup case that can be placed in a handbag.

Makeup cases traditionally carry only trays of makeup, a mirror, and brushes or pads for application of the makeup. A separate container is usually required for types of makeup or personal toiletry items that are not placed in trays. Therefore, an individual is often forced to carry a makeup compact, a lipstick case, eyebrow pencils, lip liners, mascara and perfume, all as separate items. These items are easily lost and are difficult to locate and use if placed in a handbag.

Various proposals have been made to overcome these problems and place numerous makeup and toiletry items in a single, small container. For instance, U.S. Pat. No. 5,318,053 ("the '053 patent") discloses a makeup compact that contains trays of makeup, application brushes, and tubes of lipsticks, cover sticks and makeup pencils. However, the '053 patent requires a cover to retain the tubes in their cavities. The presence of the cover presents several disadvantages.

First, the cover renders the compact somewhat inconvenient to use because the cover must be removed or the hinged top opened to access the tubes, regardless of whether or not the user wishes to access the other parts of the compact, such as the trays and mirror.

Second, the makeup case of the '053 patent provides no easy way to know which tube contains what makeup or toiletry. A user must either guess and check tubes repeatedly to find the correct one, always keep the tubes in a particular order, or attempt to make some sort of identification mark in the very limited space on the ends of the tubes. None of these methods are practical.

Third, and most significantly, if the cover opens, there is nothing to prevent the tubes from leaving the case. If the cover comes off or the hinged top comes open, an easily imaginable event in a handbag, the tubes may become scattered throughout the bag. They might also break or smear cosmetics on other articles in the bag, causing damages to those articles or to the bag itself. The tubes might also fall out while the cover is open during use, which would present a nuisance and may result in loss of the cosmetics. It would be preferable in many situations to loosen and access only one tube at a time.

SUMMARY OF THE INVENTION

The present invention overcomes the aforementioned and other problems by releasably securing a number of elongated makeup articles in cavities in the case without the use of a cover and with their ends projecting from the cavities so that they can be easily identified and removed for use.

More particularly, the present invention is a makeup case comprising a base member having a plurality of shallow cavities on one side. Each shallow cavity is adapted to receive a tray of makeup, a mirror, makeup brushes or applicators, and other makeup-related instruments. A cover member is joined to the base member by a hinge and is releasably secured in a closed position by a latch. The cover member covers the shallow cavities in the base member when in a closed position and renders the cavities exposed when open. The cover member may include a plurality of shallow cavities for the same purposes as those of the base member. Such cavities are covered by the base member when the cover member is in a closed position and are exposed when the cover member is in an open position.

Either the base member or cover member of the makeup case also has a plurality of elongated, substantially parallel cavities with ends open at a wall of the member that is spaced apart from the edge wall of the member, such as to define a recess adjacent to the edge wall. In a preferred embodiment these cavities are open at one end and closed at the other, and the open ends are located near the recess.

A makeup element is received in each elongated cavity so that an end part of the element projects from the cavity for observation of and access to the element by a user. Each cavity and the element it contains have interacting structures that releasably retain the element in the cavity in the absence of manipulation by a user to withdraw the element from the cavity.

In some embodiments of the present invention, the shallow cavities of the base member are adapted to receive trays of makeup. These trays of makeup may be permanently affixed in the cavities, or they may be removable to allow replacement by or exchange with similarly shaped trays. One cavity of the cover member contains a mirror, while the other cavities are adapted to retain makeup applicators such as brushes.

The elongated cavities may be in the provided base member on the side opposite from the side having the aforementioned cavities and are elongated along the longest dimension (length) of the base member. These cavities are designed to received elongated makeup elements such as, but not limited to, tubes of mascara, lipliner, lipstick, foundation, concealer, perfume and glitter and elements such as eyebrow pencils. The interacting structures may be any of a variety of structures located near the end part of the tube, including, but not limited to, compressible rings, a tongue and groove system, a beveled region and threads. Additionally, the outer side of the base member and the cavity walls may be transparent or translucent so that the tubes are visible when in place in the cavities.

In a further preferred embodiment, one of the elongated cavities is shorter than the cavities designed to receive tubes and is instead designed to hold a pencil sharpener. The pencil sharpener may have retention structures near the end part that are similar to those used for tube retention, or it may have a different structure to attain the releasable retention function.

In another preferred embodiment, the inner region of the base member may be hollow and the base may comprise a thickened wall comprising a plurality of cavities open at both ends. This thickened wall may be spaced apart from the edge wall of the member, such as to define a recess adjacent to the edge wall.

For a better understanding of the invention and its advantages, reference may be made to the following description of exemplary embodiments, taken in conjunction with the accompanying drawings.

DETAILED DESCRIPTION OF THE INVENTION

Figure 1:
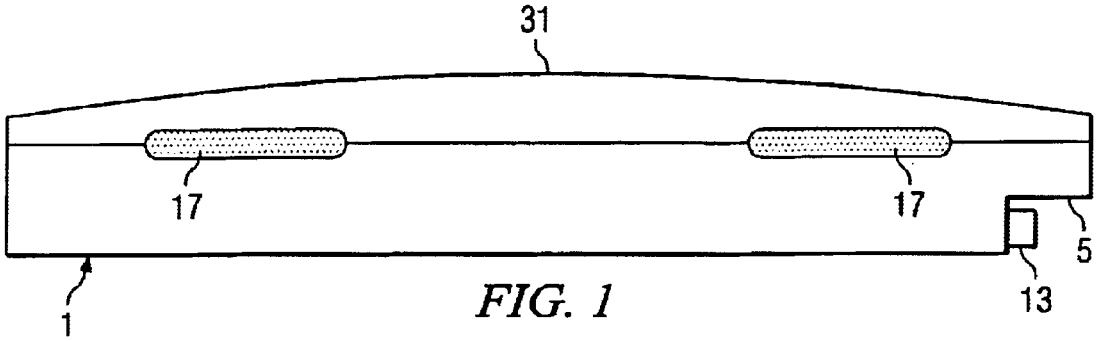
FIG. 1 is an elevational view of the rear edge of a first embodiment.

The first embodiment (FIGS. 1 to 5) has a base member 1 connected to a cover member 31 by at least one hinge 17. The base and cover member may be held closed by a clasp or latch 19. The base and cover member are fabricated from a durable material such as a polymeric material. The outer side 3 of the base member 1 is preferably fabricated from a durable translucent or transparent material.

The inner side of the base member 51 comprises a plurality of shallow cavities 53. Trays of makeup 55 may be placed in these shallow cavities. The trays of makeup may be permanently affixed in the cavities with, for example, a strong adhesive. Alternatively, the trays of makeup may be removably affixed in the shallow cavities. Trays of makeup may be removably affixed through any mechanism that allows a user to remove them for replacement when desired, but which also prevents them from falling out during normal use. For example, each tray may comprise a post 59 on its back which securely fits into a socket 57 located in a shallow cavity of the base member.

Figure 5:
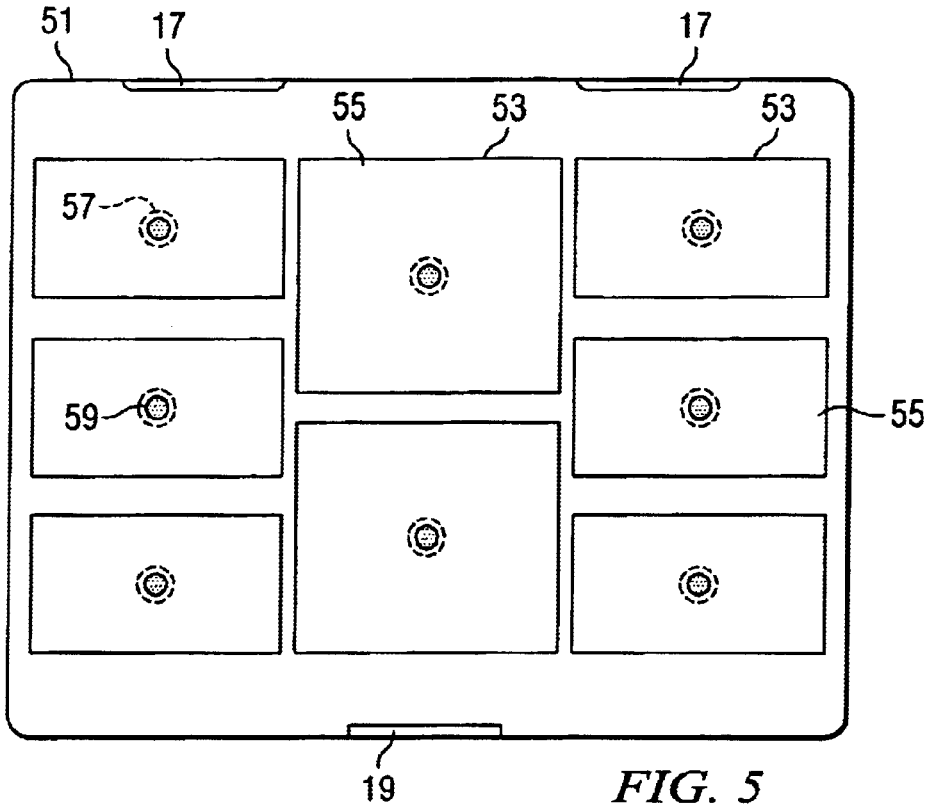
FIG. 5 is a plan view of the inner side of the base member.

Trays containing a variety of makeup items may be provided so that the removably affixed trays may be replaced with new makeup when empty or so that various colors and types of makeup may be placed in the makeup case as desired by a user. In order to facilitate exchange or replacement, it is desirable for several cavities to be of the same shape and size. An exemplary arrangement as depicted in FIG. 5, is a set six cavities of the same shape and size and another set of two cavities of the same shape and size, but different from the first set.

The inner side of the cover member may also comprise shallow cavities, one of which 43 may contain a mirror 45. Additional shallow cavities 47 may contain brushes 49 or other makeup applicators or makeup-related accessories, such as, but not limited to, makeup application pads and tweezers. When the makeup case is closed, the cover member covers the cavities and contents of the base member and vice versa.

One skilled in the art will appreciate that the configuration of any given makeup case may vary such that the shallow cavities and their contents described above as located in either the base member or the cover member may be rearranged between the members. For instance, the cover member may contain the trays of makeup and the base member the mirror and brushes. One skilled in the art will also appreciate that the arrangements of the shallow cavities and their contents need not necessarily be as described above. For example, the base member may contain both trays of makeup and brushes or makeup applicators while the cover member may contain only the mirror or the mirror and some accessories such as tweezers. In another example, both the base and cover members may contain only trays of makeup.

The base member of the makeup case additionally comprises a plurality of elongated cavities 7, each closed at one end and having an opening 11 at the other end. The open ends of these cavities open at a wall that is spaced apart from the edge wall of the base member, such as to define a recess or step 5 adjacent to the edge wall. The elongated cavities may be oriented in any manner in relation to the base, but they are preferably elongated along the longest dimension (length) of the base member. The cavities may be nearly as long as the base member and the majority of the cavities are preferably of uniform size. The cavities may be oriented so that the openings are not near an edge wall containing either a hinge or a clasp. The exposed walls of the cavities are preferably fabricated from a translucent or transparent polymeric material. It will be understood by one skilled in the art that such cavities could be placed in the cover member as an alternative to or in addition to their placement in the back member.

A makeup element 9 may be received in each elongated cavity so that an end part 13 of the element projects from the cavity for grasping of the element by a user. The end part 13 of each element 9 overlies the step, but does not protrude beyond the edge wall of the base member so that the stepped portion of the base member partly shields the end part 13 against contact with other objects in, for example, a hand bag. The shielding of the end part 13 reduces the chance of the elements 9 being dislodged from the cavities other than by manipulation by a user.

Each element 9 also has interacting structures with the elongated cavity that releasably retain the element in the cavity in the absence of manipulation by a user to withdraw the element from the cavity. These makeup elements may be tubes containing mascara, lipliner, concealer, perfume, glitter and similar applied substances, eyebrow pencils, makeup-related items and makeup applicators. Most or all of the tubes may be the same size and shape so as to be inserted interchangeably among the cavities, which are also of the same size and shape. A variety of such generally uniform makeup tubes may be provided so that a user may replace empty tubes or exchange tubes to obtain a desired combination. A makeup case designed to allow nearly any tube to be placed in nearly any cavity and also to facilitate exchange or replacement of makeup tubes is depicted in FIG. 2.

The tubular makeup elements may be color coded to indicate the general type of makeup or makeup-related item they contain (i.e. one color for lipsticks, another for eyebrow pencils, etc.) Alternatively, only the end part may be color coded for type and the remainder of the tube may be a color similar to that of or indicative of the makeup contained therein. Additionally, writing on the tube may be used for identification. Color coding of the entire tube or the end part may be beneficial when used with any embodiment of this invention. Separate color marking of only the non-end part of the tube or writing will be most useful if the outer side of the base member and the cavity walls are transparent or translucent so the writing or colors are visible when the tubes are inserted in the cavities. Alternatively, or in addition to color coding and/or translucent or transparent walls, writing may be placed above the cavities on the outer side wall. Such writing for each cavity should identify the intended contents of the tube to placed in the cavity.

Figure 2:
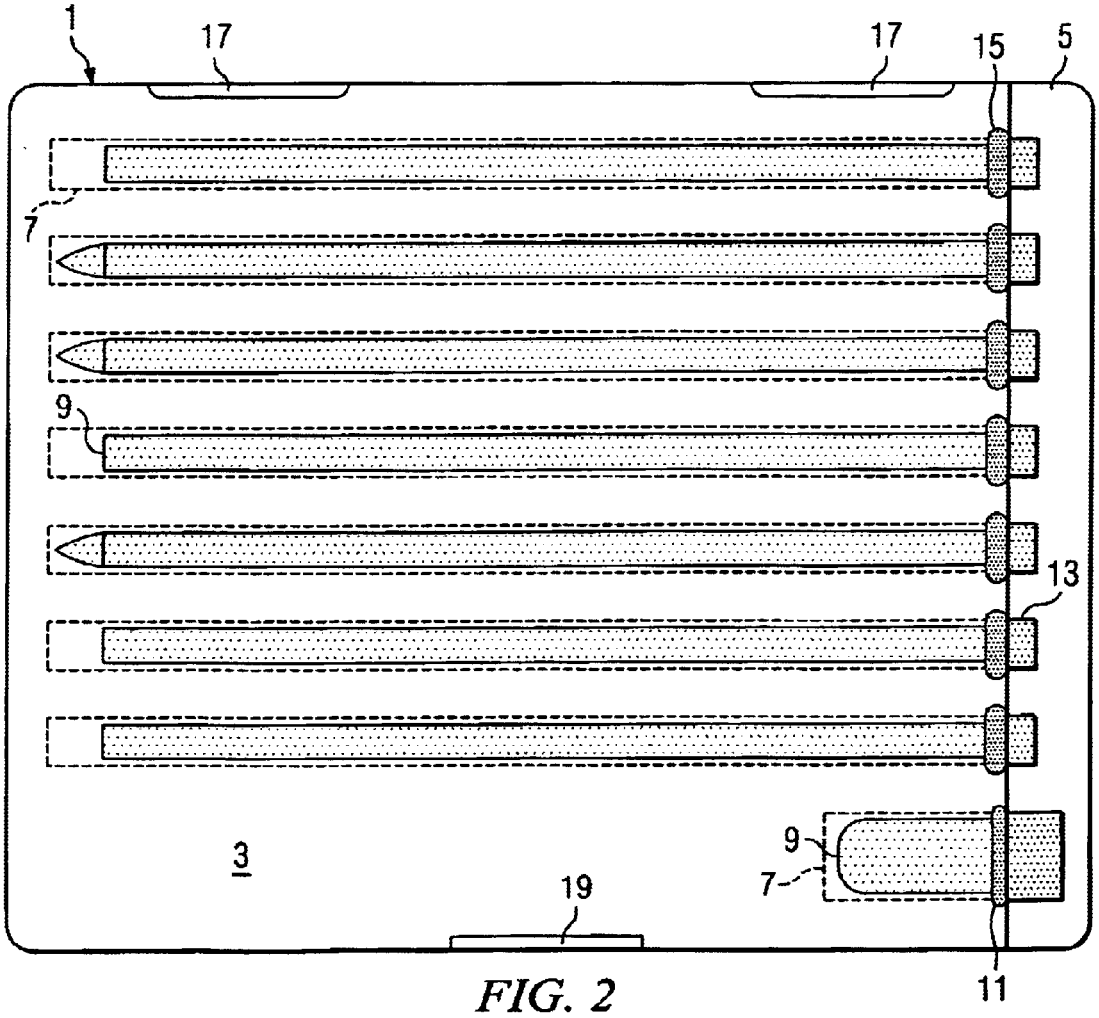
FIG. 2 is a plan view of the outer bottom side of the base of the first embodiment.
Figure 3:
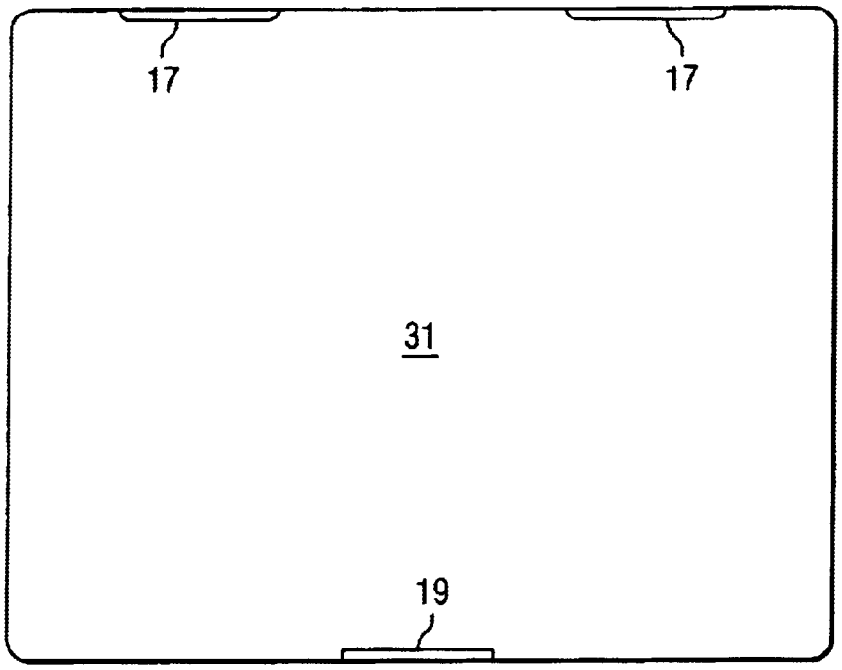
FIG. 3 is a plan view of the outer top side of the cover member.
Figure 4:
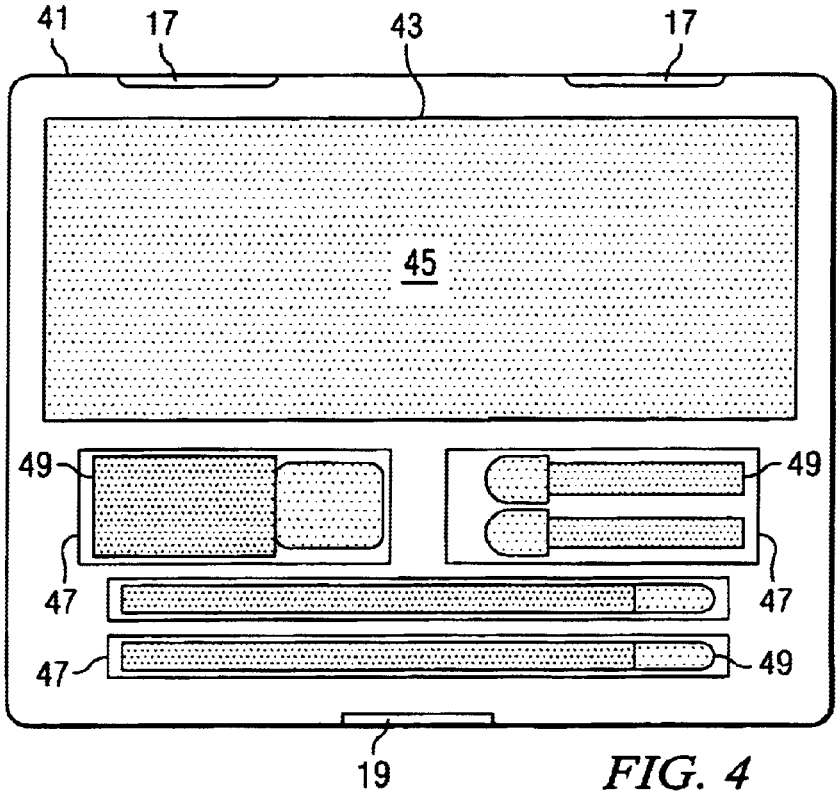
FIG. 4 is a plan view of the inner side of the cover member.

As depicted in FIG. 2, one elongated cavity of the invention may be shorter than the others and designed to receive a pencil sharpener. It is possible to design other similarly shaped makeup elements to be of generally the same dimensions as the pencil sharpener so that such elements may be exchanged or replaced as needed. More than one of the elongated cavities may be designed to receive such elements. Color coding as described for tubes may also be employed.

The makeup elements of this invention may interact with the elongated cavities so as to be retained until removed by a user through a variety of structures. These structures are preferably located near the end part of the makeup element and may include, but are not limited to, an elastically compressible ring 15, a tongue and groove system 61, a beveled region 67 and a screw system. Any given makeup case may use multiple retention structures for different cavities and makeup elements.

An embodiment of the invention employing an elastomeric ring is depicted in FIG. 2. Each makeup element 9 has a groove receiving a ring 15 near the end part 13. The ring should be designed such that it normally retains the makeup element in the cavity until pulled from the cavity by a user.

Figure 6:
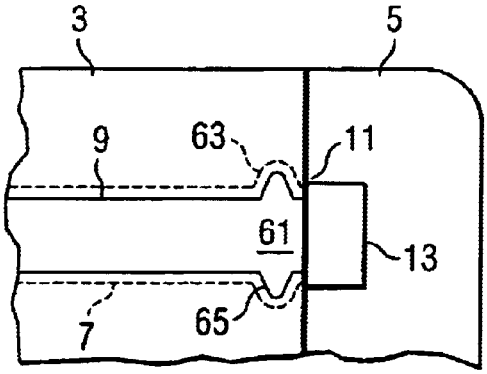
FIG. 6 is a schematic detail view of an example of structures for releasably retaining an elongated element in a cavity.

FIG. 6 depicts a tongue and groove retention structure 61. The makeup element 9 comprises a tongue 65 near the end part 13 which snaps releasably into a groove 65 in the cavity wall 7 when the makeup element is fully inserted into the cavity. The tongue and groove may be reversed so that the tongue is part of the cavity wall and the groove is part of the makeup element.

Figure 7:
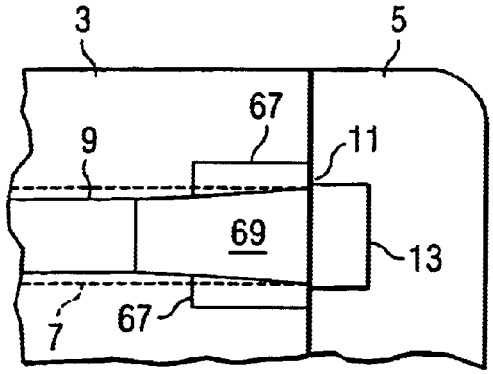
FIG. 7 is a schematic detail view of another example of structures for releasably retaining an elongated element in a cavity.

FIG. 7 depicts an embodiment of the invention in which the makeup element comprises a beveled region 67 near the end part 13 that interacts with the cavity wall 7 to snugly fit and retain the fully inserted makeup element in the cavity until it is removed by a user. The beveled region is preferably made of or encased in a polymeric material 69 which is soft, such as rubber, or which slightly adheres to the material from which the cavity wall is fabricated.

The makeup element may also be retained in the cavity through a thread system (not shown). In such a system the makeup element may comprise a portion with threads near the end part allowing it to be threaded into a threaded end part in the cavity, thereby securing the makeup element in the cavity until unscrewed by a user. A variant of threads is a bayonet coupling (also not shown).

The inner region of the base member may be hollow and the base may comprise a thickened wall comprising a plurality of cavities open at both ends. This thickened wall may be spaced apart from the edge wall of the member, such as to define a recess adjacent to the edge wall. All aspects of embodiments of the invention comprising closed cavities as described above may be easily adapted for use with this embodiment.

Although only preferred embodiments of the invention are specifically described above, it will be appreciated that modifications and variations of the invention are possible without departing from the spirit and intended scope of the invention.

What is claimed is:

1. A makeup case comprising:

a base member and a cover member joined by a hinge to operably pivot between an open position and a closed position;

each of the base and cover members having a respective outer side forming a portion of a housing and a respective inner side, wherein the inner sides are positioned adjacent each other when the members move to the closed position;

the base and cover members including a plurality of shallow cavities on their respective inner sides such that the shallow cavities are exposed in the open position, each shallow cavity being adapted to receive a tray of makeup, a mirror, a makeup brush, a makeup applicator, or a makeup-related instrument;

one of the members having a plurality of substantially parallel cavities oriented along a wall of the member and extending between the shallow cavities formed on the inner side and the outer side of the member, the parallel cavities including openings at the wall of that member that is spaced apart from an edge wall of the member, such as to define a recess adjacent the edge wall; and a makeup element received in each parallel cavity, each respective makeup element having an end part projecting from the parallel cavity for access to the makeup element by a user, and each makeup element having interacting functions with the parallel cavity that releasably retains the element in the parallel cavity in the absence of manipulation by the user to withdraw the element from the parallel cavity.

2. The makeup case of claim 1, wherein the substantially parallel cavities are elongated and have an open end and a closed end with the open end located adjacent to the recess.

3. The makeup case of claim 1, wherein the member comprising the substantially parallel cavities is hollow and the cavities are open at both ends and are contained in a thickened wall spaced apart from the edge wall of the member.

4. The makeup case of claim 1, wherein the outer side of the member comprising the substantially parallel cavities is fabricated from a translucent or transparent material.

5. The makeup case of claim 1, wherein the walls of the substantially parallel cavities are fabricated from a translucent or transparent material.

6. The makeup case of claim 1, wherein the makeup elements are releasably retained in the cavities by a ring, a tongue and groove system, a beveled region, or a screw system.

7. The makeup case of claim 1, wherein the shallow cavities of the base member are adapted to receive trays of makeup.

8. The makeup case of claim 7, wherein the trays of makeup are permanently affixed in the shallow cavities.

9. The makeup case of claim 7, wherein the trays of makeup are removable from the shallow cavities.

10. The makeup case of claim 1, wherein the makeup elements are selected from the group consisting of: tubes of mascara, lipliner, lipstick, foundation, concealer, perfume, glitter and eyebrow pencils.

11. The makeup case of claim 1, wherein at least one makeup element is a pencil sharpener.

12. The makeup case of claim 1, further comprising a clasp operable to releasably retain the base and cover members in a closed position.

* * * * *